US007303419B1

(12) United States Patent
Ju

(10) Patent No.: US 7,303,419 B1
(45) Date of Patent: Dec. 4, 2007

(54) CONNECTOR

(75) Inventor: Ted Ju, Keelung (TW)

(73) Assignee: Lotes Co., Ltd., Keelung (TW)

( * ) Notice: Subject to any disclaimer, the term of this patent is extended or adjusted under 35 U.S.C. 154(b) by 0 days.

(21) Appl. No.: 11/635,571

(22) Filed: Dec. 8, 2006

(51) Int. Cl.
*H01R 13/62* (2006.01)

(52) U.S. Cl. ..... 439/327; 439/630; 439/157

(58) Field of Classification Search ..... 439/327, 439/630, 157

See application file for complete search history.

(56) References Cited

U.S. PATENT DOCUMENTS 5,722,851 A * 3/1998 Onizuka et al. ..... 439/404
5,823,828 A * 10/1998 Bricaud et al. ..... 439/630
6,095,868 A * 8/2000 Hyland et al. ..... 439/630
6,500,018 B1 * 12/2002 Pfaffenberger et al. ..... 439/325
6,556,452 B2 * 4/2003 Ruff ..... 361/759

* cited by examiner

*Primary Examiner*—Truc Nguyen
(74) *Attorney, Agent, or Firm*—Troxell Law Office, PLLC

(57) ABSTRACT

A connector for electric connection has an insulating body, a plurality of conductive terminals receiving in the insulating body, and a retaining device for retaining the electric card to the connector. The retaining device has a main body. The main body has an inserting portion for inserting electric card. A side board extends from the main body for buckling the electric card. A fixing potion extends from the side board for fixing the insulating body. Comparing to the prior art, because the connector has a larger size of the main body, a damage of a surface of an electric card can reduced. Besides, the connector is capable of prevent the electric card from displacement at a vertical direction. The electric card can be disassembled or assembled by retaining device accompanying with that the retaining device is removed or connected to the connector.

8 Claims, 5 Drawing Sheets

CONNECTOR

BACKGROUND OF THE INVENTION (a) Field of the Invention

The present invention relates to connectors, in particular a connector with a retaining device.

(b) Description of the Prior Art

The Chinese Patent No. 00255700.2 is illustrated with a connector. The connector has an inserting groove connector and a retaining device. The inserting groove connector is shaped as a rectangular. The inserting groove connector has a retaining portion installed on the two end of the inserting groove connector for fixing the retaining device, and an inserting groove capable of corresponding to a card-type electric unit. The two sides of the inserting groove have a plurality of terminal receiving slots. A plurality of conductive terminals are received in the receiving slots. The retaining device is capable of fixing on the inserting groove connector. The retaining device has two fixing arms corresponding to each other and tow connecting portions for connecting the two fixing arms. One end of the fixing arm is connected with the connecting portion. The other end of the fixing arm has a fixing portion capable of corresponding to the retaining portion for fixing thereof. The connecting portion is shaped as a prop. On a lateral side of the connector corresponding to the two fixing arms at an extending direction has a resisting surface. The resisting surface has a buckling body for buckling the edge of the card-style electric unit and an elastic resisting sheet for resisting the card-style electric unit. However, the connector can buckle only the edge of the electric card. A surface of the electric card is easy to be damaged because of external force from an unexpected object.

Therefore, it is necessary to have a novel buckle device to overcome the defects of the prior art.

SUMMARY OF THE INVENTION

The primary objective of the present invention is to provide a connector for reducing damages of a surface of an electric card.

Comparing to a prior art, the connector has a larger surface of a main body so that a possibility of damaging the surface of the electric card can be reduced. Besides, the electric card can be positioned firmly so as to prevent form displacement thereof at a vertical direction. The electric card can be disassembled or assembled by retaining device accompanying with that the retaining device is removed or connected to the connector.

DETAILED DESCRIPTION OF THE PREFERRED EMBODIMENTS

In order that those skilled in the art can further understand the present invention, a description will be described in the following in details. However, these descriptions and the appended drawings are only used to cause those skilled in the art to understand the objects, features, and characteristics of the present invention, but not to be used to confine the scope and spirit of the present invention defined in the appended claims.

Figure 1:
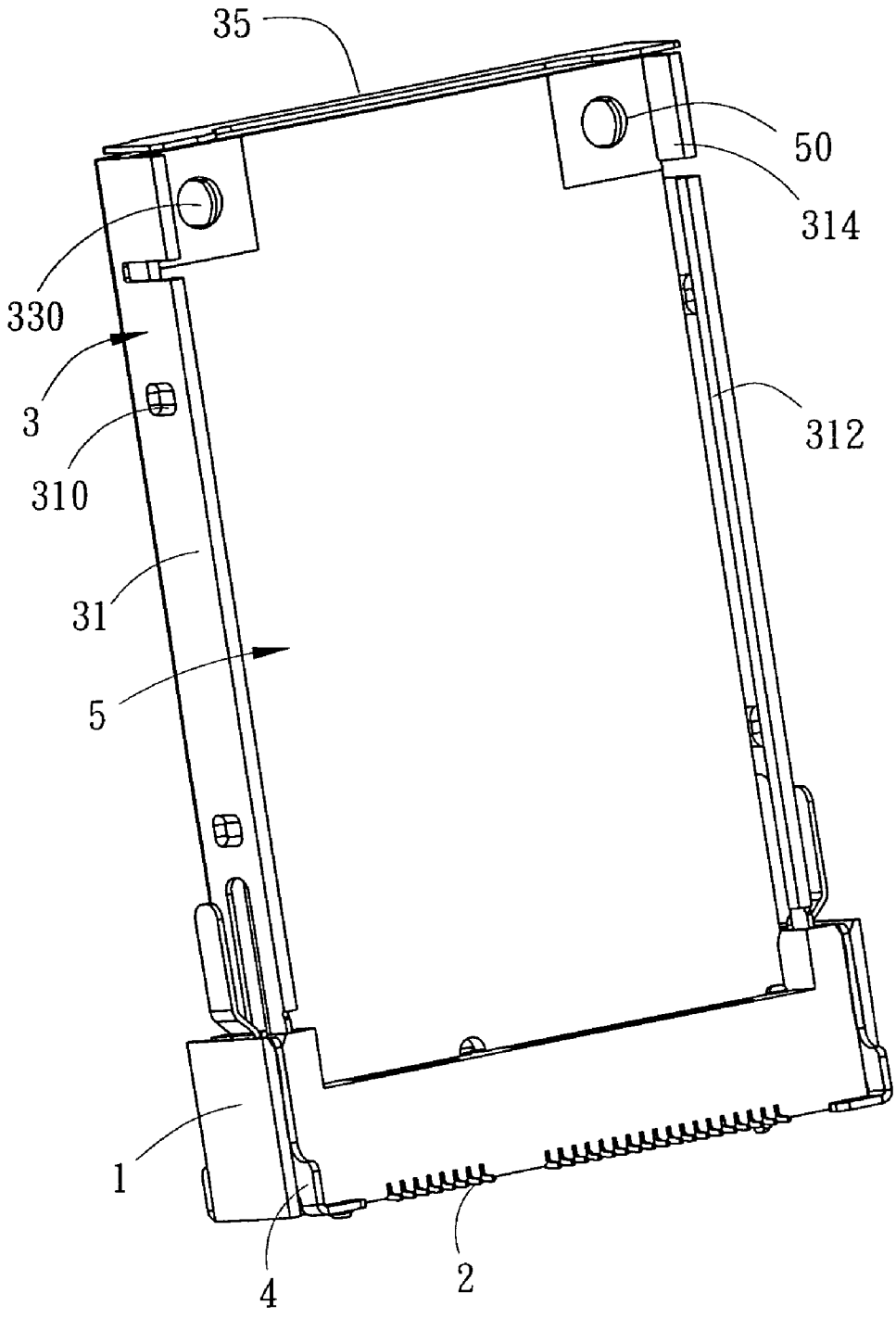
FIG. 1 is an assembled perspective view of the connector of the present invention and the electric card.
Figure 2:
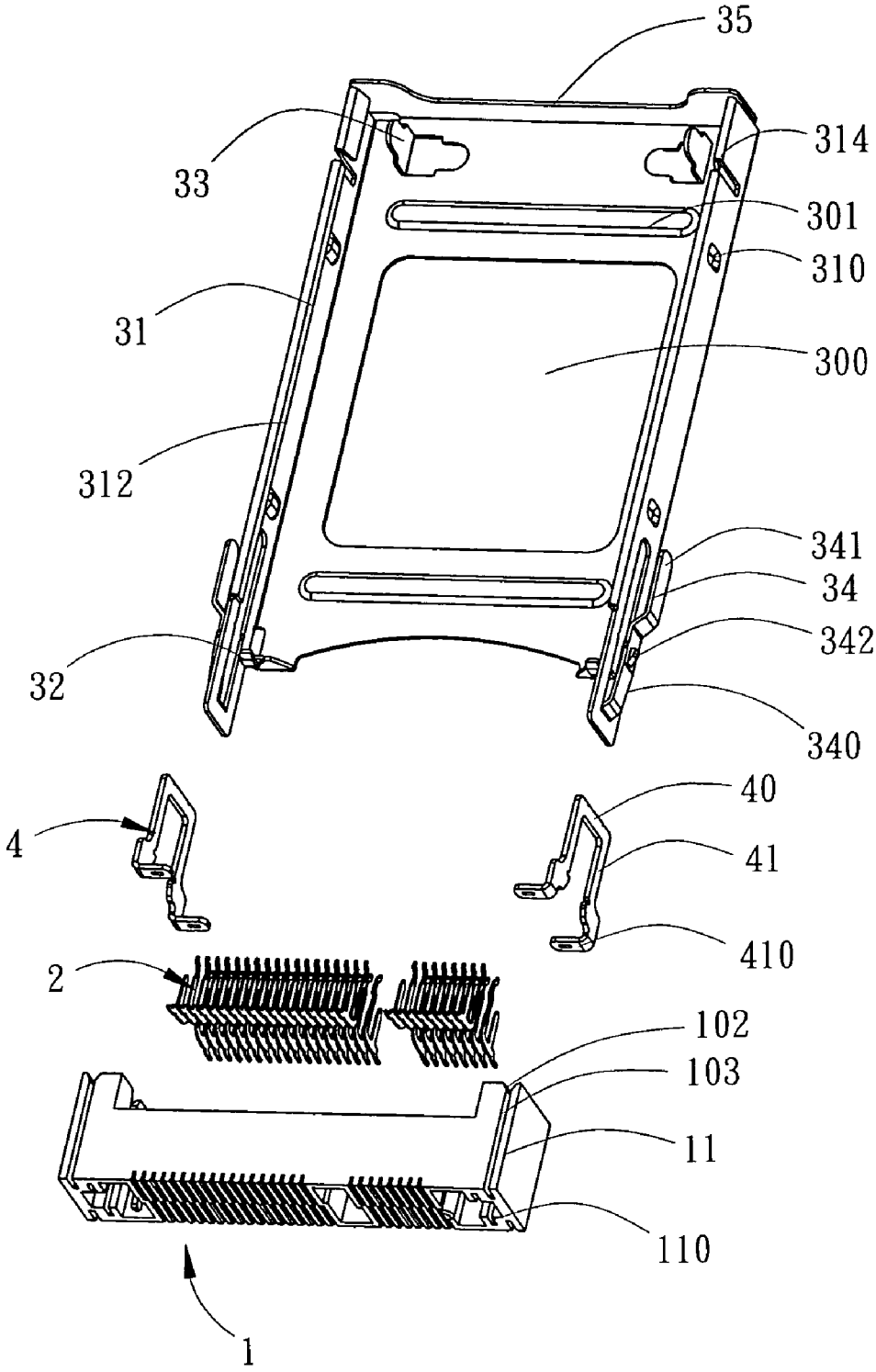
FIG. 2 is an exploded perspective view of the connector of the present invention.
Figure 3:
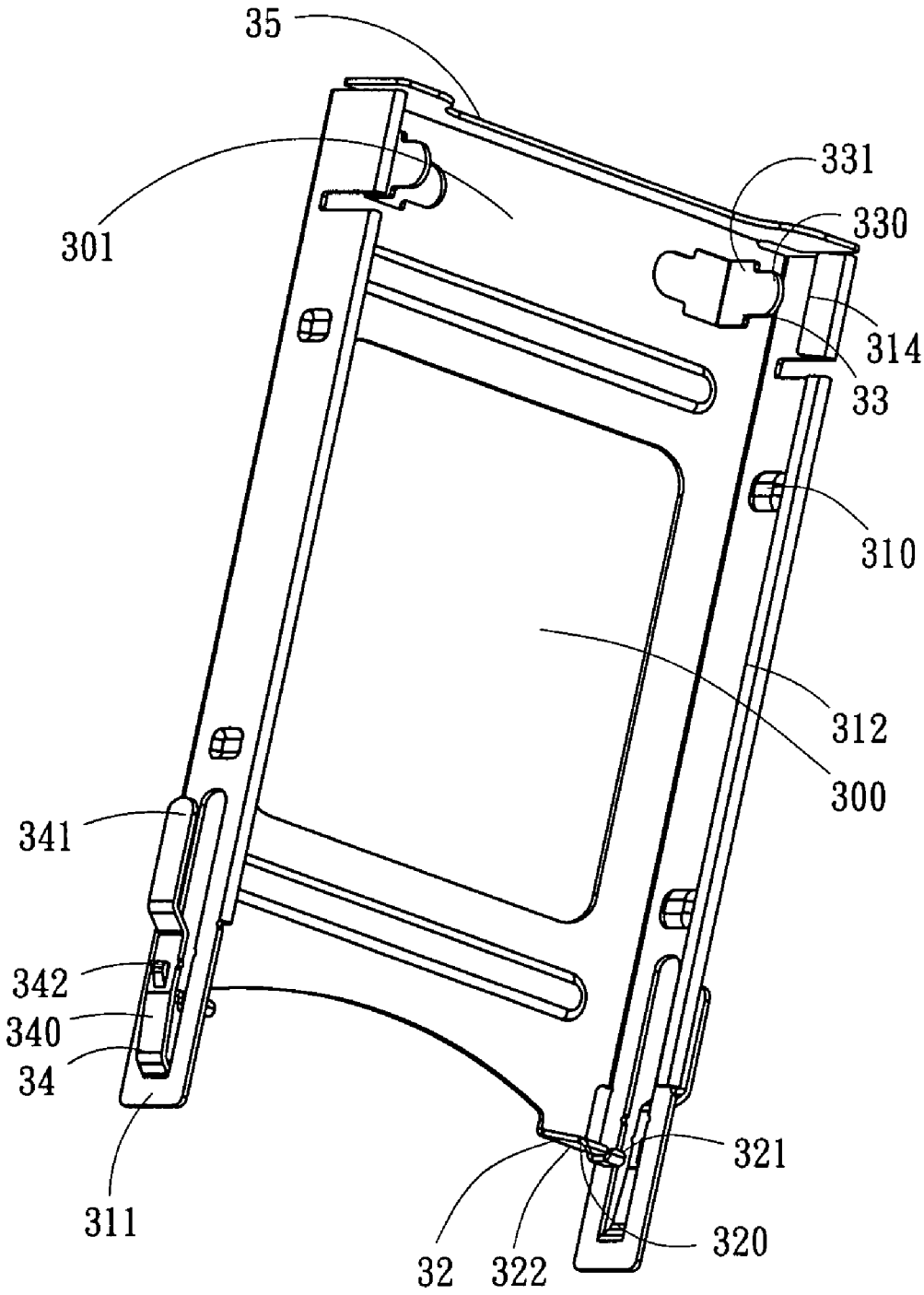
FIG. 3 is a perspective view of the retaining device of the present invention.
Figure 4:
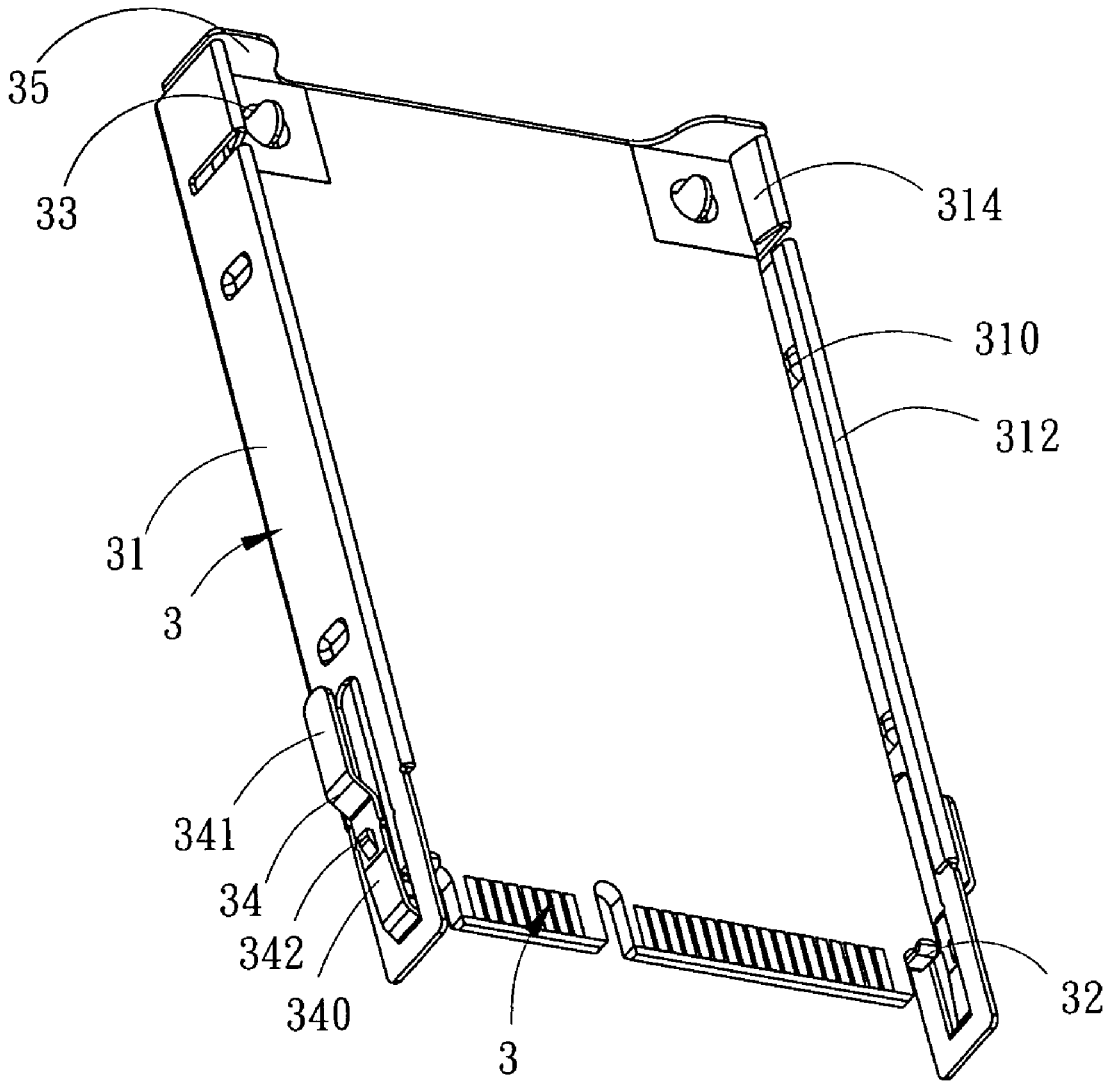
FIG. 4 is an assembled perspective view of the retaining device of the connector of the present invention and the electric card.
Figure 5:
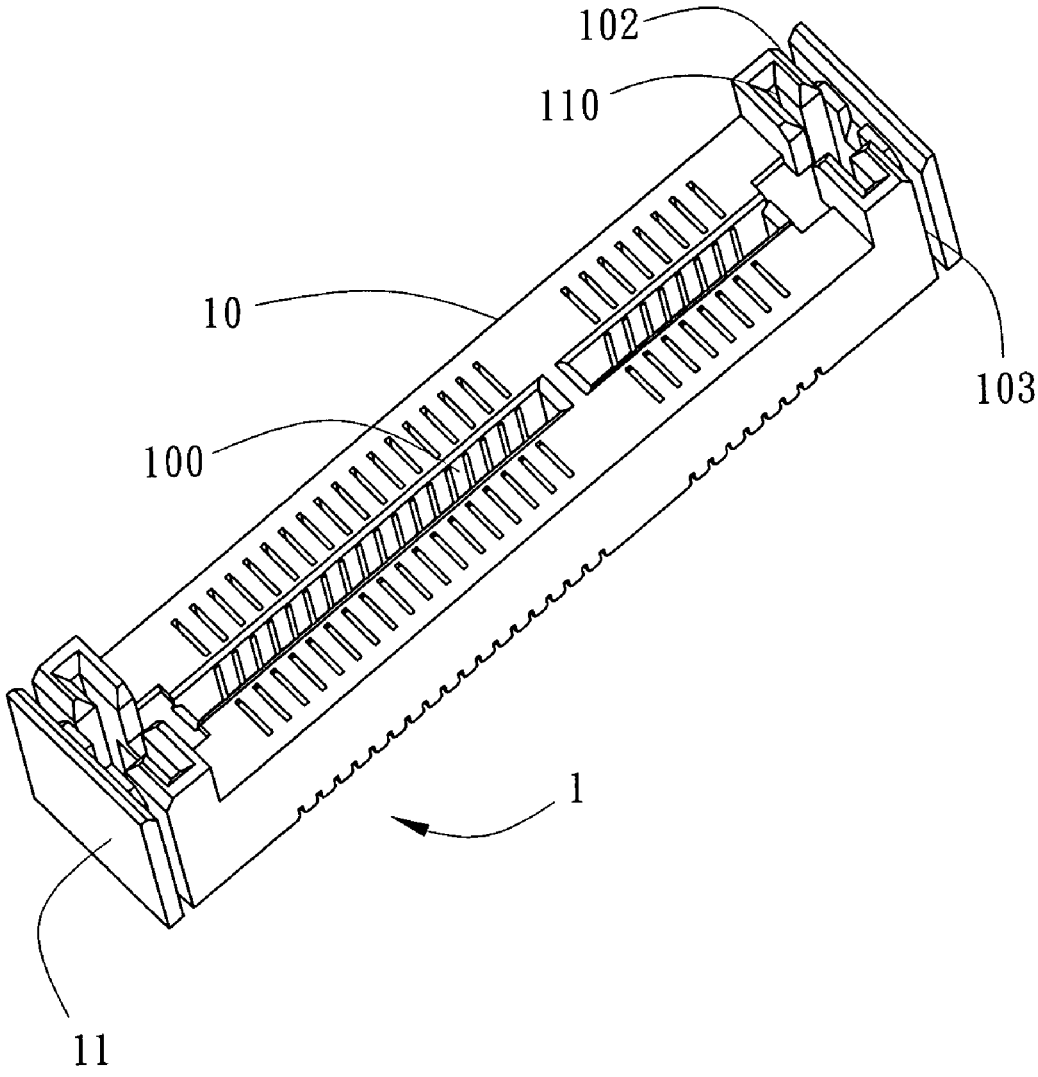
FIG. 5 is a perspective view of the insulating body of the connector of the present invention.

Referring to FIGS. 2 to 5, the connector of the present invention has an insulating body 1, a plurality of conductive terminal 2 received in the insulating body 1, a retaining device 3, and a fixing unit 4 for fixing the connector to the electric board. The connector serves to connect conductively an electric card 5 to the electric board (not shown).

The insulating body 1 has a main body 10 and arms 11 extending respectively from the two ends of the main body 10. The main body 10 along with a vertical direction thereof has a central slot 100 for receiving the electric card 5. Each arm 11 has a first groove 102. A second groove 103 extends vertically downwards from the two ends of the first groove 102 symmetrically. The arm 11 has a hole 110 for inserting a retaining device 3.

The retaining device 3 formed approximately as a U-shape serves to retain the electric card 5. The retaining device 3 has a main body 30, a side board 31, a buckling portion 32, an inserting portion 33, a fixing portion 34 and an upper block board 35. The main body 30 has an interval with a surface of the electric card 5. A side board 31 extends and folds from the two side edges of the main body 30. A curl edge 312 extends from the upper end with curling inward of side board 31 for a security reason, because of thin material of the side board 31 forming as sharp sides. The buckling portion 32 extends from a below end with curling of the main body 30. The main body 30 has passing holes 50 for installing the electric card 5 so that the inserting portion 33 can prevent the electric card 5 from displacement at vertical direction. An upper end of the side board 31 has a buckle corresponding to the inserting portion 33 and a block slice 314 bounding the electric card 5. An upper end of the main body 30 curls upwards and folds to form an upper block board 35 to prevent the electric card 5 from an above strike. The retaining device 3 has two fixing portions 34 extending from the two side boards 31 with curling outwards and folding. The main body 30 is shaped as a board-shape. A central section of the main body 30 is opened as a square hole 300. Both an upper side and a below side of the hole 300 have respectively a strengthening rib 301 sidelong extending to form so as to strengthen the main body 30. Each the side board 31 has two protrusions 310 positioned at a specific interval distance for buckling the electric card 5. The protrusion 310 can prevent the electric card 5 from displacement at a vertical direction. A below end of the side board 31 has an inserting device 311 for inserting a hole 110 of the connector. The buckling portion 32 has a cantilever 320 extending vertically from a surface of the main body 30, a buckling piece 321 formed by curling and folding the cantilever 320, and a connecting portion 311 for connecting buckling portion 32 to the main body 30. The cantilever 320 can prevent the electric card 5 from displacement at a vertical direction. The buckling piece 321 can prevent the electric card 5 from displacement at the surface of the main body 30. The inserting portion 33 extends vertically from the level surface of the main body 30. The inserting portion 33 has a inserting pin 330 and a resisting area 331 positioned at the rear end of the inserting portion 33 capable of resisting against a surface of the electric card 5. The inserting portion 33 inserts into the hole 50 on the electric card 5 so as to prevent the electric card 5 from displacement at a vertical direction. The inserting portion 33 and block slice 314 serves to buckle the electric card 5 so as to prevent the electric card 5 from a movement at a left or a right side. The fixing portion 34 is formed by extending with curling outwards from the inserting device 311. The fixing portion 34 has a base 340 and an operation portion 341 formed by extending curling outwards from an upper end of the base 340. A block slice 314 protrudes outwards from the base 340. The retaining device 3 is assembled with the connector by the block slice 314 and the fixing unit 4.

The fixing unit 4 is made of iron. At least a part of the fixing unit 4 serves to hook a surface of an inserting card side of the insulating body 1 (the fixing unit 4 is cross to the insulating body 1 in the embodiment). The fixing unit 4 has a first arm 40 and a second arm 41 extending downwards vertically from the second arm 41. The first arm 40 is buckled into the first groove 102. The second arm 41 is buckled into the second groove 103. Each below end of the second arm 41 by at least one time of curling is extended to form a conductive portion 410 (The conductive portion 410 extends from the below end of the second arm 41 by one time of curling at a level direction).

When assembling, the electric card 5 is buckled with the retaining device 3 at first. The assembling steps are as the following descriptions. The electric card 5 is positioned between the upper block board 35 and buckling portion 32. The inserting portion 33 is inserted into the passing hole 50 of the electric card 5. The inserting portion 33 accompanying with the block slice 314 serves to buckle the electric card 5 and prevents the electric card 5 from a movement at a left or right direction. The cantilever 320 clips to the below end of the electric card 5. The buckling piece 321 resists against the front surface of the electric card 5. Besides, the protrusion 310 of the side board 31 resists against the side edge of the electric card 5. Thereby, the electric card 5 can be fixed firmly on the retaining device 3 to form a component unit. Then, the fixing unit 4 serves to fix the connector to the electric board. Assembling steps are as the following descriptions. The first arm 40 of the fixing unit 4 is buckled into the first groove 102. The second arm 41 is buckled into the second groove 103. The fixing unit 4 is welded on the electric board 5. Finally, an assembly of electric card 5 and retaining device is installed on the connector. The inserting portion 33 of the retaining device 3 should be inserted surely into the hole 110. The buckling spot 342 accompanying with the first arm 40 of the fixing unit 4 fixes the assembly of the retaining device 3 and the electric card 5 to the connector. If the electric card 5 should be taken out, then a user should pull inwards the operation portion 341 so as to separate the buckling spot 342 to the first arm 40. Thereby, the electric card 5 can be taken out conveniently.

The present invention is thus described, and it will be obvious that the same may be varied in many ways. Such variations are not to be regarded as a departure from the spirit and scope of the present invention, and all such modifications as would be obvious to one skilled in the art are intended to be included within the scope of the following claims.

What is claimed is:

1. A connector for electric connection comprising:

an insulating body;

a plurality of conductive terminals receiving in the insulating body;

a retaining device for retaining an electric card to the connector; the retaining device having a main body; the main body having an inserting portion for inserting the electric card;

a side board extending from the main body for buckling the electric card, a lower end of the side board has an inserting device; and a fixing portion extending from the side board for fixing the insulating body, wherein a fixing portion extends outwards by curling and folding from the inserting device; the upper end of the fixing device extends outwards by curling to form an operation portion; a buckling spot protrudes outwards from the fixing portion.

2. The connector as claimed in claim 1, wherein a gap exists between the main body of the retaining device and a surface of the electric card.

3. The connector as claimed in claim 1, wherein an upper end of the side board has a block slice accompanying with the inserting portion for buckling the electric card.

4. The connector as claimed in claim 1, wherein the lower end of the main body has at least one of a buckling portion for preventing the electric card for displacement at a vertical direction; and the buckling portion serves to buckle or separate the electric card to the connector with the retaining device being assembled or disassembled.

5. The connector as claimed in claim 1, wherein the main body of the retaining device has a plurality of strengthening ribs.

6. The connector as claimed in claim 1, wherein each side board has at least one protrusion for buckling the electric card.

7. The connector as claimed in claim 1, wherein the inserting portion has an inserting pin for inserting into a hole of the electric card and a resisting area for resist a surface of the electric card.

8. The connector as claimed in claim 1, wherein the upper end of the main body is extended upward by curling and folding to form an upper block board for preventing the electric card from above external force.

* * * * *